United States Patent [19]

Aviram et al.

[11] Patent Number: 4,692,044

[45] **Date of Patent: * Sep. 8, 1987**

[54] INTERFACE RESISTANCE AND KNEE VOLTAGE ENHANCEMENT IN RESISTIVE RIBBON PRINTING

[75] Inventors: Ari Aviram, Croton-on-Hudson; Kwang K. Shih, Yorktown Heights, both of N.Y.

[73] Assignee: International Business Machines Corporation, Armonk, N.Y.

[ * ] Notice: The portion of the term of this patent subsequent to Aug. 23, 2000 has been disclaimed.

[21] Appl. No.: 728,996

[22] Filed: Apr. 30, 1985

[51] Int. Cl.[4] ..... B41J 31/02

[52] U.S. Cl. ..... 400/241.1; 400/120; 428/913; 428/914

[58] Field of Search ..... 400/120, 241, 241.1, 400/241.2, 241.3, 241.4; 428/266, 391, 447, 448, 450, 913, 914

[56] References Cited

U.S. PATENT DOCUMENTS

| | | | |
|---|---|---|---|
| 3,744,611 | 7/1973 | Montanari et al. | 400/120 |
| 4,309,117 | 1/1982 | Chang et al. | 400/241.1 |
| 4,317,123 | 2/1982 | Namiki et al. | 428/447 X |
| 4,356,233 | 10/1982 | Lange et al. | 428/448 X |
| 4,400,100 | 8/1983 | Aviram et al. | 400/120 |
| 4,470,714 | 9/1984 | Aviram et al. | 400/241.1 |
| 4,491,431 | 1/1985 | Aviram et al. | 400/241.1 |
| 4,491,432 | 1/1985 | Aviram et al. | 400/241.1 |

FOREIGN PATENT DOCUMENTS

| | | | |
|---|---|---|---|
| 0016320 | 10/1980 | European Pat. Off. | 400/120 |
| 0041099 | 12/1981 | European Pat. Off. | 400/120 |

OTHER PUBLICATIONS

IBM Technical Disclosure Bulletin, "Thermal Biasing Technique for Electrothermic Printing", Wilbur, vol. 23, No. 9, Feb. 1981, p. 4302.

IBM Technical Disclosure Bulletin, "Improved Conductive Path for Electrothermal Ribbon," Wilbur, vol. 24, No. 11B, Apr. 1982, pp. 6192–6193.

*Primary Examiner*—Ernest T. Wright, Jr.

*Attorney, Agent, or Firm*—Jackson E. Stanland

[57] ABSTRACT

An improved resistive ribbon for thermal transfer printing is provided, where the ribbon includes a resistive layer, a metal current-return layer, a fusible ink layer, and an electric interface layer located between the resistive layer and the metal layer. The electrical interface layer is sufficiently thin so as not to impair the required mechanical properties of the ribbon (such as flexibility, stability, durability, etc.), and has as its primary function the enhancement of the electrical porperties of the ribbon. Specifically, interface resistance and/or knee voltage of the current-voltage characteristics of the ribbon are enhanced by the electrical interface layer.

Preferred compositions of the interface layer include alkylalkoxy silanes of a specific formula, and especially nonsymmetrical compounds of that formula.

18 Claims, 9 Drawing Figures

INTERFACE RESISTANCE AND KNEE VOLTAGE ENHANCEMENT IN RESISTIVE RIBBON PRINTING

DESCRIPTION

1. Field of the Invention

This invention relates to resistive ribbon thermal transfer of ink from a ribbon to a carrier and, more particularly, to an improved ribbon including a resistive layer through which electrical current flows, a metal layer serving as a current-return, a layer of fusible ink, and a layer between the resistive layer and the metal current return layer for enhancing the electrical properties of the ribbon.

2. Background Art

The art of non-impact printing is becoming increasingly popular for producing high quality written material, where such characteristics are desirable. Among the non-impact printing techniques, thermal transfer printing has proved particularly desirable where high quality, low volume printing is necessary, such as in computer terminals and typewriters. In thermal transfer printing, ink is printed on the face of a receiving material (such as paper) whenever a fusible ink layer brought into contact with the receiving surface is softened by a source of thermal energy. The thermal energy can be supplied from a source of electricity, the electrical energy being converted to thermal energy.

In one type of thermal transfer printing, termed resistive ribbon thermal transfer, a thin ribbon is used. The ribbon is generally comprised of either three or four layers, including a support layer, a layer of fusible ink that is brought into contact with the receiving medium, and a layer of electrically resistive material. In a variation, the resistive layer is thick enough to be the support layer, so that a separate support layer is not needed. A thin electrically conductive layer is also optionally provided to serve as a current return.

In order to transfer ink from the fusible ink layer to the receiving medium, the layer of ink is brought into contact with the receiving surface. The ribbon is also contacted by an electrical power supply and selectively contacted by a thin printing stylus at those points opposite the receiving surface where it is desired to print. When current is applied to the thin printing stylus, it travels through the resistive layer and causes local resistive heating, which melts a small volume of ink in the fusible ink layer. This melted ink is then transferred to the receiving medium to effect printing. Resistive ribbon thermal transfer printing is described in U.S. Pat. Nos. 3,744,611; 4,309,117; 4,400,100; 4,491,431; and 4,491,432.

In resistive ribbon thermal transfer printing, it is often the situation that the substrate contact to the printing head becomes unduly heated and debris accumulates on the printhead. This increases contact resistance and develops heat in the printhead. To overcome the accumulation of debris and the increasing contact resistance, the amplitude of the applied current has to be increased. This is disadvantageous, however, because it can produce adverse fumes and ruin the substrate.

A technique for reducing the amount of power required to be supplied by the printhead in a resistive ribbon thermal transfer process is described in IBM Technical Disclosure Bulletin, Vol. 23, No. 9, February 1981, at page 4302. In this approach, a bias current is provided through a roller into the resistive layer located in the printing ribbon. The bias current produces some heating so that not all of the energy required to melt the ink has to be applied through the printhead.

Copending U.S. Patent application Ser. No. 356,657, filed Mar. 10, 1982, now U.S. Pat. No. 4,470,714 in the names of Aviram and Shih and assigned to the same assignee as the present application, describes an improved resistive ribbon for use in thermal transfer printing. As noted in this copending application, prior art attempts to provide resistive ribbons for thermal transfer printing typically encountered significant limitations. For example, the material selected to support both the fusible ink layer and the resistive layer has been difficult to adhere to other layers of the ribbon. Another problem arises because the same supporting layer may act as a thermal barrier to the transfer of heat from the resistive layer to the ink layer, thereby impeding the printing process. Additionally, the resistive layers of prior art ribbons have typically been comprised of graphite dispersed in a binder. Since these resistive layers require a great deal of energy for heating, it has sometimes been the situation that the resistive layer would burn through before printing occurred, with the release of adverse fumes.

In order to overcome these obstacles, the resistive ribbon of aforementioned U.S. Pat. No. 4,470,714 proposed the use of an inorganic resistive layer, preferrably comprised of a binary alloy. One example of such a resistive layer is a metal silicide layer. These resistive materials were used to induce resistive heating at very low energy inputs and to avoid the need for a polymeric binder in the resistive layer. This was to eliminate the burn-through problem described above, and also to avoid the possibility of toxic fumes, which may occur when polymeric binders are used.

In resistive ribbons of the prior art, and especially as typified by U.S. Pat. No. 4,470,714, a characteristic often appeared which could be troublesome. This characteristic was a switching behavior in which the impedance level of the resistive layer changed at a certain voltage. At initial non-printing voltages, the materials of the prior art would exhibit high impedance. However, when a certain voltage was reached (termed the knee voltage), the resistive material would switch to a low impedance state. As a result, a "holding" voltage (i.e., the voltage associated with the low impedance state) was obtained wherein the current through the resistive layer sharply increases. The holding voltage in these materials (such as the binary alloys) is typically about 1.5 volts. The presence of this switching behavior means that constant current power sources can be used only with difficulty, and therefore constant voltage power sources have been preferred.

Since resistive layers commonly require a certain level of power in order to induce sufficient resistive heating to adequately melt the fusible ink layer, it is preferrable that the voltage of the low impedance state (in which printing occurs) be as high as possible. For a constant power, this means that the magnitude of required current can be brought into the range available from the power supply. In the practice of the present invention this problem has been solved by using a resistive ribbon including an additional, thin layer between the resistive layer and the metal current return layer, in order to enhance the electrical properties of the ribbon. In particular, this additional layer increases the interface resistance and the knee voltage so that, when the impedance state changes, the change will occur at a higher holding voltage. In turn, this will minimize the magnitude of the required current. Both constant current sources and constant voltage sources can be successfully employed when this additional layer is used in the resistive ribbon.

In resistive ribbon thermal transfer printing, it is advantageous if the heat required for printing is produced as close as possible to the fusible ink layer. In the practice of the present invention, the additional layer provides increased interface resistance, that is, resistance at a location very close to the thermal ink layer. This heat can be easily and rapidly conducted through the thin metal current-return layer to provide efficient localized heating of the ink layer. Further, the magnitude and nature of the interface resistance has a direct bearing on the magnitude of the knee voltage. The present invention serves to increase the knee voltage beyond 6–7 volts, and therefore provides relatively low printing currents.

In the prior art, it has not been possible to increase interface resistance and knee voltage beyond approximately 6 volts. Further, it has not been possible to provide resistive ribbons having enhanced interface resistance and knee voltage while still providing ribbon flexibility and durability, as well as good adhesion between the various layers of the ribbon. Still further, in previous resistive ribbons using aluminum having a coating of aluminum oxide thereon, other difficulties arose. While these films would exhibit an impedance switching behavior, it was very difficult to enhance the knee voltage and interface resistance to desired levels. Further, the aluminum oxide films cannot be produced as continuous, pinhole-free films having reproducible and controllable properties.

Accordingly, it is a primary object of this invention to provide an improved resistive printing ribbon in which both interface resistance and knee voltage can be enhanced.

It is another object of this invention to provide an improved resistive printing ribbon which provides printing at lower printing currents, with higher speed than prior art resistive ribbons.

It is another object of the present invention to provide an improved resistive printing ribbon having enhanced mechanical stability and durability, while still retaining the flexibility of prior art resistive ribbons.

It is another object of the present invention to provide a resistive printing ribbon having improved electrical properties, while at the same time providing enhanced durability.

It is another object of the present invention to provide an improved resistive printing ribbon having enhanced interface resistance and an inert interface where the localized heating occurs.

It is a further object of the present invention to provide an improved resistive ribbon, where many metals can be used for the current-return layer.

It is a still further object of the present invention to provide an improved resistive printing ribbon having enhanced interface resistance and knee voltage, without leading to reversible switching behavior in the current-voltage characteristics of the ribbon.

It is a further object of the present invention to provide an improved resistive printing ribbon wherein well known materials can be used in the ribbon to provide enhanced electrical properties and lower print currents.

It is another object of the present invention to provide a resistive printing ribbon in which the interface resistance and knee voltage can be increased or decreased easily.

It is another object of the present invention to provide an improved resistive printing ribbon in which the interface resistance and knee voltage can be adjusted in accordance with the thickness of a layer in the ribbon.

It is another object of this invention to provide an improved resistive printing ribbon using an additional layer for control of interface resistance and knee voltage, where the additional layer can be made thin and pinhole-free to ensure uniformly enhanced electrical properties.

DISCLOSURE OF THE INVENTION

The improved resistive printing ribbon of this invention is generally comprised of a resistive layer, a fusible ink layer, a thin metal current-return layer, and an additional layer located between the resistive layer and the thin metal layer, the additional layer being used to provide enhanced electrical properties of the ribbon. The additional layer has a thickness of about 500–1000 angstroms, and is used to impart a non-linearity in the current-voltage characteristic of the ribbon. This non-linearity occurs at a knee voltage of greater than 6 volts. The onset of non-linearity is not reversible even over short time intervals. Thus, once the non-linearity is reached and the current-voltage characteristic changes to a low impedance state, a reduction in current will not cause the same curve to be followed. Thus, an essentially constant voltage can be used, where the voltage is in excess of 6 volts.

The additional layer in the resistive ribbon, termed an "electrical" interface layer, is continuous and pinhole free, and can be made with constant thickness by well known techniques. Generally, the electrical interface layer is comprised of a polymer so that solvent casting, plasma polymerization, etc. can be used to deposit the layer. A suitable class of materials for the electrical layer is alkylalkoxy silanes having the general formula:

$$(RO)_m—Si—(R')_{4-m}$$

where $m=1,3$ (non-symmetrical materials)

$m=2,4$ (symmetrical materials)

$R=—CH_3, (CH_2)_p—CH_3$ $p=0,1,2,3$ $R'=(CH_2)_n—CH_3$ $n=0,1,2, \ldots, 21,$ and branched isomers thereof.

If $m=1$ or 3, these materials are non-symmetrical, and will enhance both interface resistance and knee voltage. However, if $m=2$ or 4, the materials will be symmetrical and the primary effect of the electrical layer will be an enhancement of the interface resistance (if the knee voltage is enhanced, it is only by a very small amount when symmetrical alkylalkoxy silanes are used).

The improved resistive printing ribbon of this invention provides printing at lower currents and with higher speed, without requiring techniques such as chemical heat amplification. Lower printing currents are also provided in a controllable manner without causing electrode fouling. Still further, both interface resistance and knee voltage can be simultaneously enhanced by the use of the electrical layer in accordance with this invention. While interface resistance and knee voltage are enhanced, the possibility of switching and bi-stability is not a problem, and very high knee voltages can be obtained.

As additional advantages, the electrical interface layer provides a very stable and inert interface which is not subject to environment or humidity problems. Also, the metal current-return layer can be comprised of metals other than Al including, for example, Au, Ni, Cu, stainless steel, etc.

Different silanes have been used as bonding layers in resistive ribbons, as noted in aforementioned U.S. Pat. No. 4,400,100. In that patent, a thin organic adhesion promoter is used between the resistive layer and the aluminum current-return layer. The adhesion promoter is an alkoxysilane compound including an amine for bonding the polycarbonate resistive layer and a siloxane for bonding with the aluminum. No mention is made of the electrical properties of the adhesion promotion layer. Further, adhesion promotion layers can be very thin, for example, one monolayer, which would be too thin to affect the electrical properties of the ribbon. In addition to these differences, where the electrical interface layer of the present invention is an alkylalkoxy silane, no amine group is used. This contrasts with the adhesion layer of U.S. Pat. No. 4,400,100, where an amine group is required for adhesion to the polycarbonate resistive layer.

These and other objects, features, and advantages will be apparent from the following more particular description of the preferred embodiments.

BEST MODE FOR CARRYING OUT THE INVENTION

In the practice of this invention, the electrical characteristics of a resistive printing ribbon are improved by the inclusion of an additional layer between the resistive layer and the metal current-return layer. As noted, advantages in addition to the enhancement of electrical properties also result, since the electrical interface layer allows the use of metals other than aluminum as the metal current-return layer.

As will become more apparent later, the enhanced electrical properties can include both an increase in interface resistance and in knee voltage, where both of these increases are dependent upon the thickness of this additional layer. Further, the onset of the nonlinearity leading to the knee voltage is not reversible, even over very short time intervals (i.e., short electrical pulses and rapid pulse repetition times). The provision of this additional layer does not impair the flexibility of the resistive ribbon, and in many ways enhances its durability and mechanical stability by providing an interface which is inert to the environment.

Figure 1:
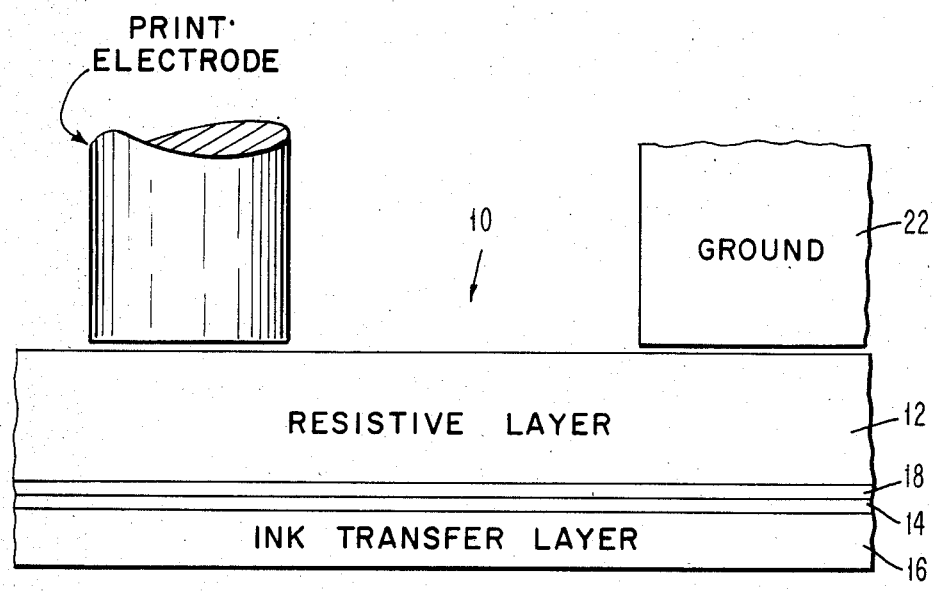
FIG. 1 schematically illustrates a resistive ribbon in accordance with the present invention, which can be used for printing applications when current is passed through the electrodes.

Referring now to FIG. 1, a schematic illustration of the resistive ribbon 10 and the structure required for resistive ribbon thermal transfer printing are shown. Ribbon 10 is comprised of a resistive layer 12 an optional thin metal current-return layer 14, an ink layer 16, and the electrical interface layer 18 located between resistive layer 12 and metal layer 14. A print electrode 20 and a portion of the ground electrode 22 are also shown.

The operation of the resistive ribbon printing technique is well known in the art, and will not be described in detail. When a current is provided through electrode 20, it will travel through the resistive layer 12, electrical layer 18 and metal layer 14, before returning to ground through the large ground electrode 22. This passage of electrical current causes heat to be developed in the resistive layer 12 and in the electrical layer 18, and in particular provides a high interface resistance in layer 18. This localized heat is transmitted to the ink layer 16, causing it to be locally melted and transferred to a carrier, such as paper (not shown).

The components which can be used for the resistive layer 12, metal layer 14, optional ink release layer, and ink layer 16 are well known in the art. In the practice of this invention the materials comprising these layers can be selected from any of the well known materials used for these layers. Resistive layer 12 can be comprised of polycarbonate filled with graphite. For example, resistive combinations can be prepared from about 75%–65% polycarbonate, by weight, and from about 20%–35% of carbon, by weight. Other suitable materials for resistive layer 12 include polyimide containing about 20–35% carbon, polyester containing about 20–32% carbon, and polyurethane containing about 20–30% carbon. Of course, other polymeric materials may be used and the amount of carbon is selected to obtain the appropriate resistance. A representative thickness of the resistive layer 12 is approximately 17 micrometers, in a printing system using current pulses of 20–30 mA.

The thermally transferrable ink layer 16 is usually comprised of a polymeric material which has a melting point of about 100° C., and a color former. An example of a suitable ink is one which contains a polyamide and carbon black. These inks are also well known in the art (see, for example, Macromelt 6203 prepared by Henkel Corp. and containing carbon black). Ink layer 16 is typically about 5 micrometers thick.

Metal layer 14 is used as a current-return layer, and is preferably Al. However, in the practice of this invention other metals can be used including stainless steel, Cu, Mg, and Au. One advantage of the present invention is that high quality printing will be obtained regardless of the metal which is used in layer 14, in contrast with prior art ribbons which often require a particular metal in order to provide good print quality. The thickness of layer 14 is typically about 1000 angstroms.

The electrical interface layer 18 is about 500–1000 angstroms in thickness, and is a uniform, continuous, pinhole-free layer which can be easily formed on the resistive layer 12. In a preferred embodiment, layer 18 is a polymer comprised of alkylalkoxy silanes having the general formula $$(RO)_m—Si—(R')_{4-m}$$

where m=1,3 (non-symmetrical materials)
m=2,4 (symmetrical materials)
$R=—CH_3$, $(CH_2)_p—CH_3$
p=0,1,2,3
$R'=(CH_2)_n—CH_3$
n=0,1,2, . . . ,21 and branched isomers thereof.

Examples of suitable branched isomers for the group R' include

2-Methylbutyl $$—CH_2—\underset{\underset{CH_3}{|}}{CH}—CH_2—CH_3$$

3-Ethylpentyl $$—CH_2—CH_2—\underset{\underset{\underset{CH_3}{|}}{CH_2}}{\underset{|}{CH}}—CH_2\ \ CH_3$$

The electrical interface layer is chosen to be one which will introduce an interface resistance close to the ink transfer layer 16, and also one in which the knee voltage of the current-voltage characteristic of the ribbon is enhanced (i.e., increased). Specifically, the material of layer 18 is one which makes the knee voltage in excess of 6 volts. The resistivity of layer 18 can be varied depending upon its composition, and expedients such as doping can be used to adjust the interface resistance and knee voltage.

As an example, thin layers of polymerized octadecyltriethoxy silane, 500–1000 angstroms thick, were coated on the resistive layers in three separate ribbons. In the first ribbon, the knee voltage of the ribbon without the electrical interface layer was about 7 volts. The presence of the electrical interface layer moved the knee voltage to a value between 9 and 12 volts. In another ribbon, the initial knee voltage (i.e., without the electrical interface layer) was approximately 0 volts. The presence of an electrical interface layer comprising octadecyltriethoxy silane moved the knee voltage to 8 volts. In the third ribbon, the presence of the electrical interface layer provided an increase in knee voltage of approximately 4 volts.

The polymer electrical interface layer can easily be deposited by known techniques including plasma polymerization, vapor deposition, and solvent casting. Well known coating techniques such as blading, dipping, spraying, silk screening and the like can be used. In the case of plasma polymerization, either a liquid or a vapor can be introduced into the plasma chamber. For example, the resistive polycarbonate layer can be placed in the plasma chamber which contains vapors of the alkylalkoxy silanes of the present invention. Following a few minutes exposure, the thin electric interface layer will be formed.

As further examples, the following materials were coated as thin layers between a conductive polycarbonate layer (resistive layer) and an Al ground return layer, in order to form the electrical interface layer. These materials were:

1. Octadecyltriethoxy silane dissolved in alcohol;
2. Polydimethyl siloxane acetoxy terminated dissolved in kerosene or petroleum ether; and
3. Polyimide dissolved in 1 methyl 2 pyrrolidone.

Each of these materials was coated on the surface of the polycarbonate by a roller, then dried in air or in a heated oven to form the electrical interface layer. Al was then deposited on the interface layer, and I-V measurements were undertaken. The improvements due to the interface layers are illustrated in the following table.

| Material | Max. Knee Voltage Increase Observed* | Interface Resistance Increase Compared to Untreated Sample |
|---|---|---|
| Octadecyltriethoxy Silane dissolved in Alcohol | °3 V | °4 times |
| Polyimide dissolved in 1 methyl 2 pyrrolidone | °2 V | °5 times |
| Poly Dimethy Siloxane dissolved in Kerosene | °3 V | °4 times |
| Poly Dimethy Siloxane dissolved in petroleum Ether | °5 V | °7 times |

*For an untreated sample, the Knee voltage is about 7 volts.

For the alkylalkoxy silanes described above, it has been observed that the non-symmetrical silane compounds (when m=1, 3) exhibit both enhanced interfacial resistance and enhanced knee voltage. In contrast with this, symmetric alkylalkoxy silanes (where m=2, 4) exhibit enhanced interface resistance, but do not significantly enhance the knee voltage. The reason for this difference is not fully known, but it is indicative of the unexpected uniqueness of this class of materials.

ELECTRICAL CHARACTERISTICS

Figure 2:
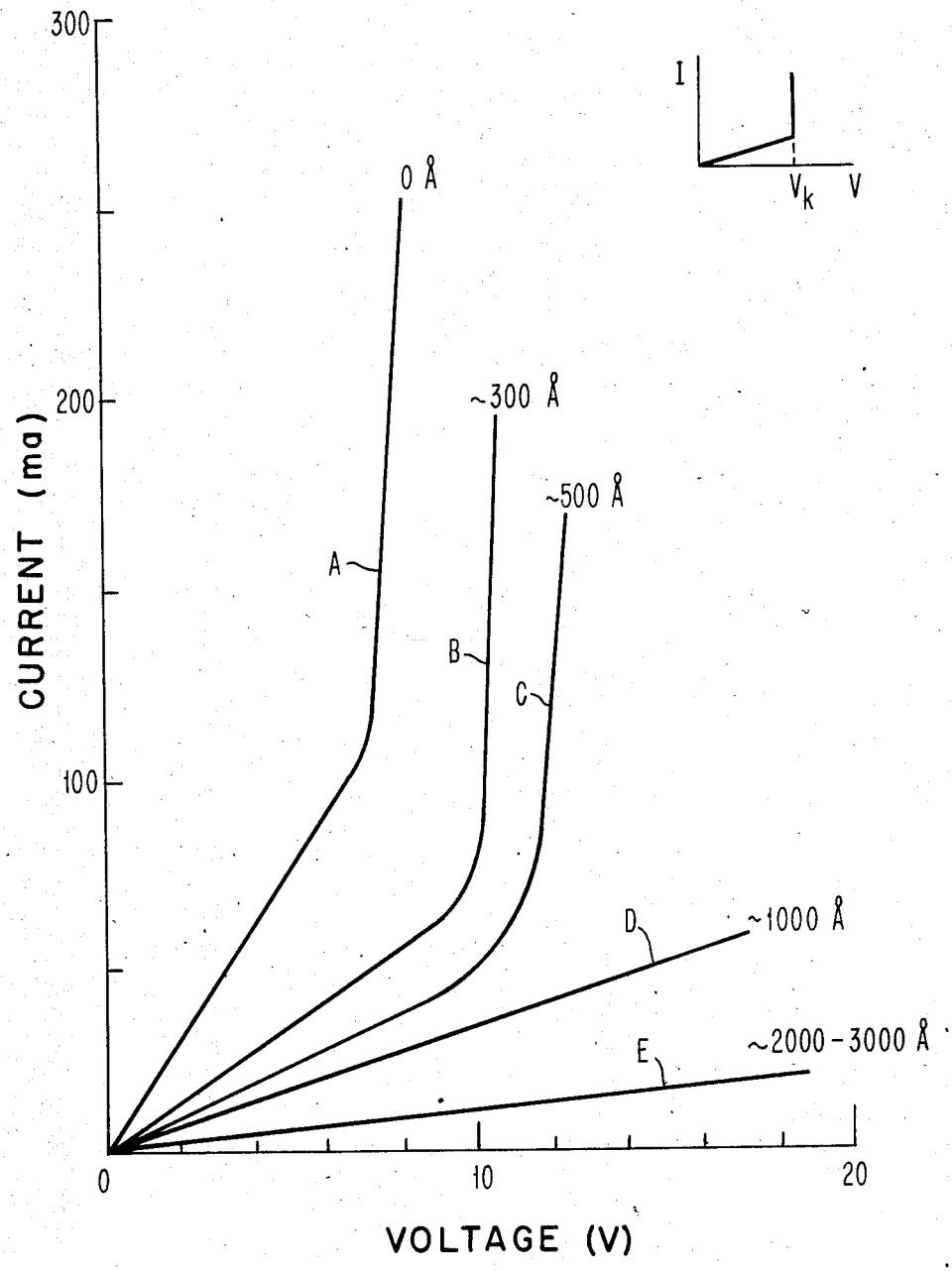
FIG. 2 is a current-voltage (IV) characteristic of the ribbon of FIG. 1, for different thicknesses of an electrical interface layer comprised of plasma polymerized octadecyltriedhoxy silane.

FIGS. 2–9 show the electrical characteristics of various ribbon samples, and illustrate the effects of the addition of the electrical interface layer to a ribbon. For example, FIG. 2 is a current-voltage (I-V) plot for a ribbon comprising a resistive layer of polycarbonate and a 1000 angstrom thick Al metal layer. Samples of this type of ribbon were made with different thicknesses of an electrical interface layer located between the resistive layer and the Al metal layer. The resulting I-V curves are shown in FIG. 2 for a ribbon with no electrical interface layer, and for ribbons with various thicknesses of the interface layer. These thicknesses were about 300, 500, 1000, and 2000–3000 angstroms. Thus, curve A illustrates the ribbon where no electrical interface layer is present, while curves B–E show the I-V characteristics as the thickness of the interface layer increases from about 300 angstoms to about 2000–3000 angstroms.

In the ribbons used for the measurements in FIG. 2, the electrical interface was plasma polymerized octadecyltriethoxy silane. The presence of this layer enhanced the initial resistance and also enhanced the knee voltage $V_K$ of the ribbon, where $V_K$ is defined in the inset in FIG. 2. In order to eliminate the effect of contact resistance, 5 mil Au dots were deposited on the resistance layers. During the measurements 50 microsecond continuous voltage pulses were applied. This technique was also used to obtain the electrical characteristics in FIGS. 3–9.

This interface layer gives the ribbon a non-linear I-V characteristic in which the initial slope of the I-V curves is a measure of the interface resistance. As the thickness of the interface layer increases, this interface resistance increases. Thus, a resistance close to the ink layer is produced in order to have a sizeable quantity of heat produced in the region closest to the ink layer. As noted earlier, these more favorable I-V curves allow printing at lower currents.

Figure 3:
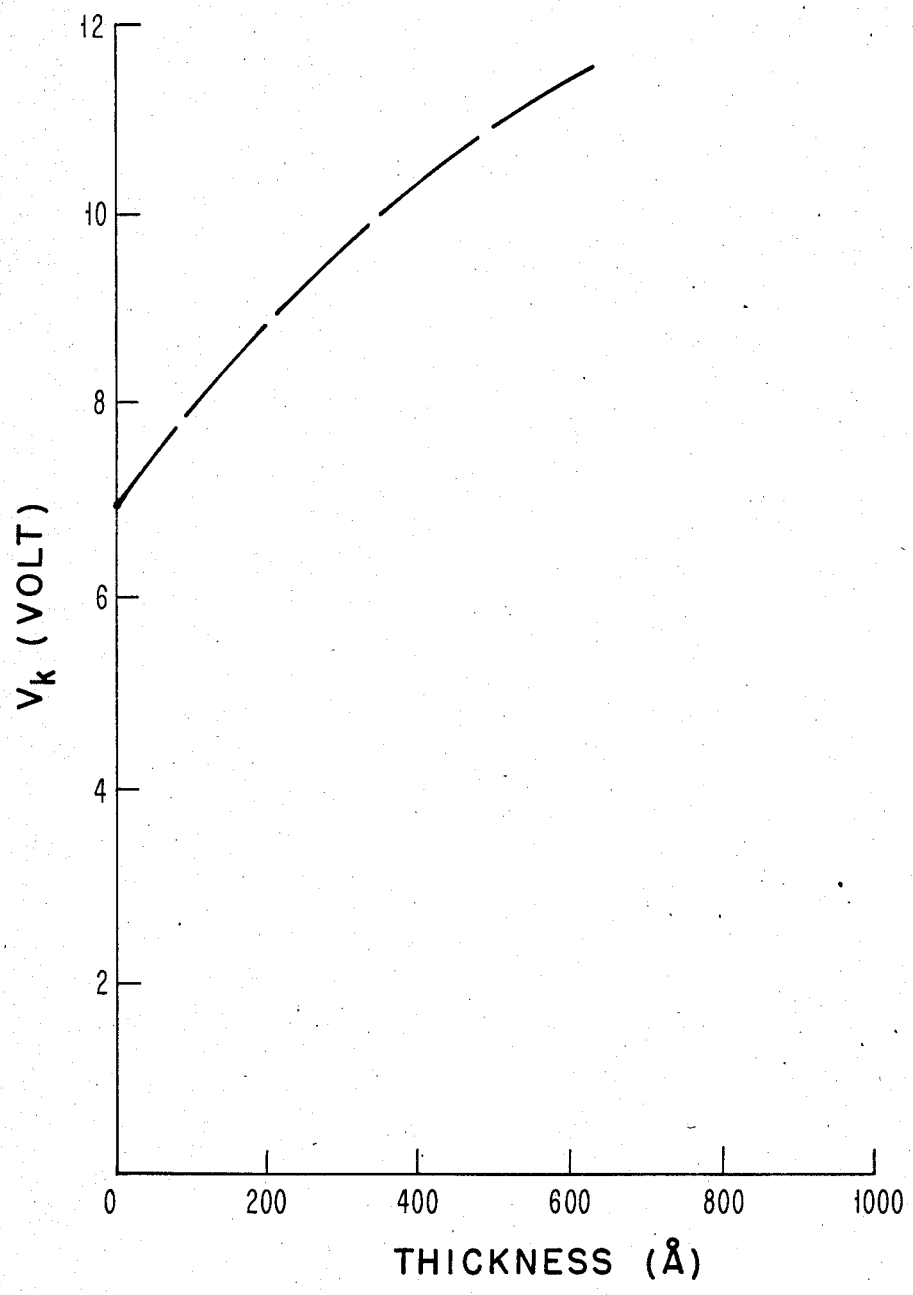
FIG. 3 is a plot of knee voltage $V_K$ versus thickness of the electrical layers in the ribbons having the I-V characteristics of FIG. 2.

FIG. 3 plots the knee voltage $V_K$ against the thickness of the electric layer 18 (FIG. 1). This plot was obtained in the same manner, using sample ribbons having the I-V characteristics of FIG. 2. As is apparent from FIG. 3, the knee voltage $V_K$ increases with the thickness of the interface layer in a manner which is non-linear with thickness.

Figure 4:
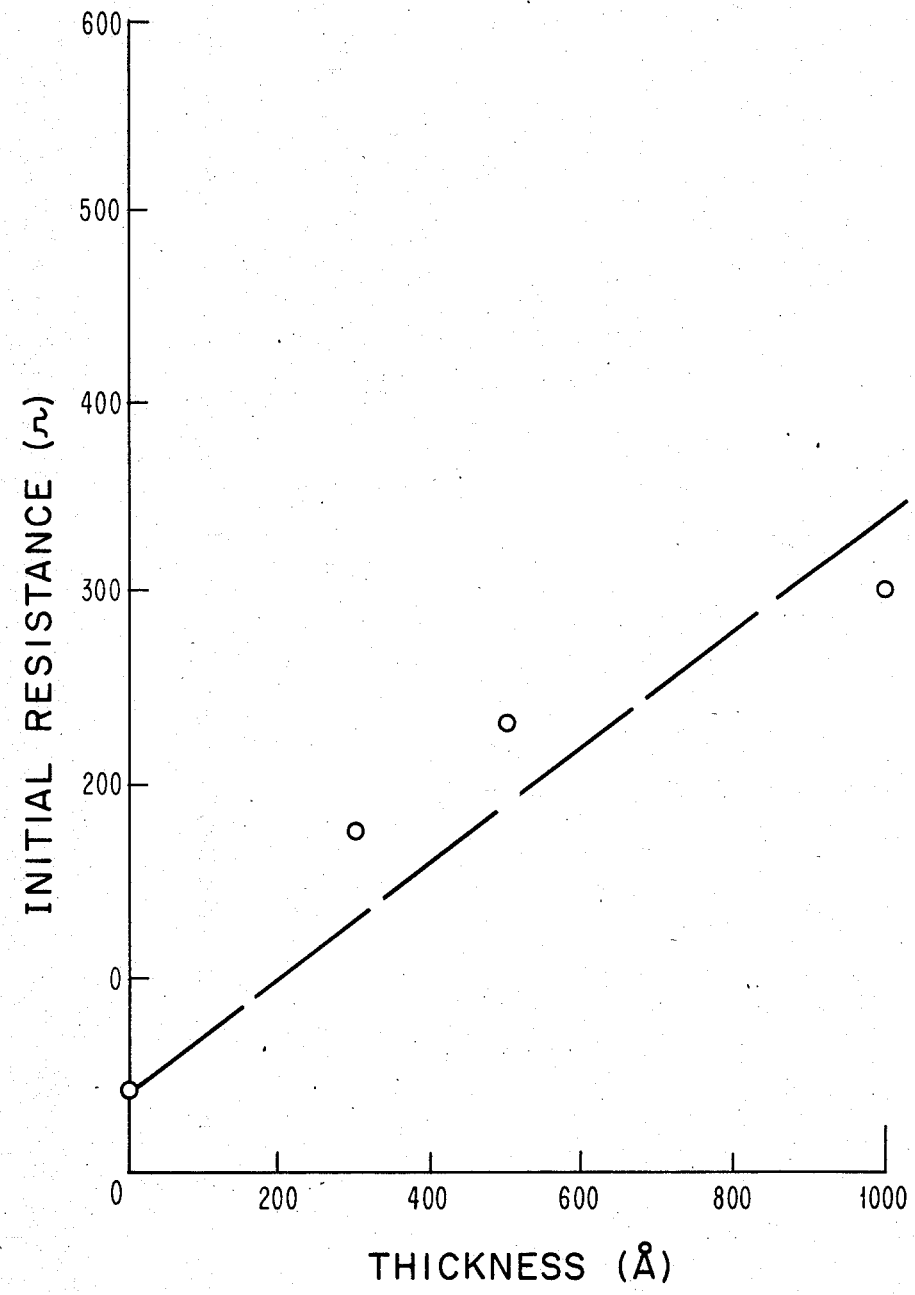
FIG. 4 is a plot of initial resistance, which is proportional to interface resistance, versus thickness of the electrical interface layer, where this interface layer is comprised of plasma polymerized octadecyltriedhoxy silane.

FIG. 4 is a plot of the initial resistance of a resistive ribbon as a function of the thickness of the electrical layer 18. This ribbon was comprised of a polycarbonate resistive layer and a 1000 angstrom thick Al layer. Various thicknesses of an electrical interface layer were used between the resistive layer and the Al metal layer. In the samples used to plot FIG. 4, the electrical interface layers were plasma polymerized octadecyltriethoxy silane compound. Their thicknesses were between 0 and 1000 angstroms.

In FIG. 4, the initial resistance increases substantially linearily with the thickness of the electrical interface layer. The initial resistance is comprised of the interface resistance and a small series resistance, and is substantially proportional to the interface resistance. The results of FIG. 4 are consistent with those in FIG. 2, where the initial portions of the I-V curves showed increasing resistance as the thickness of the electrical interface layer increased.

Figure 5:
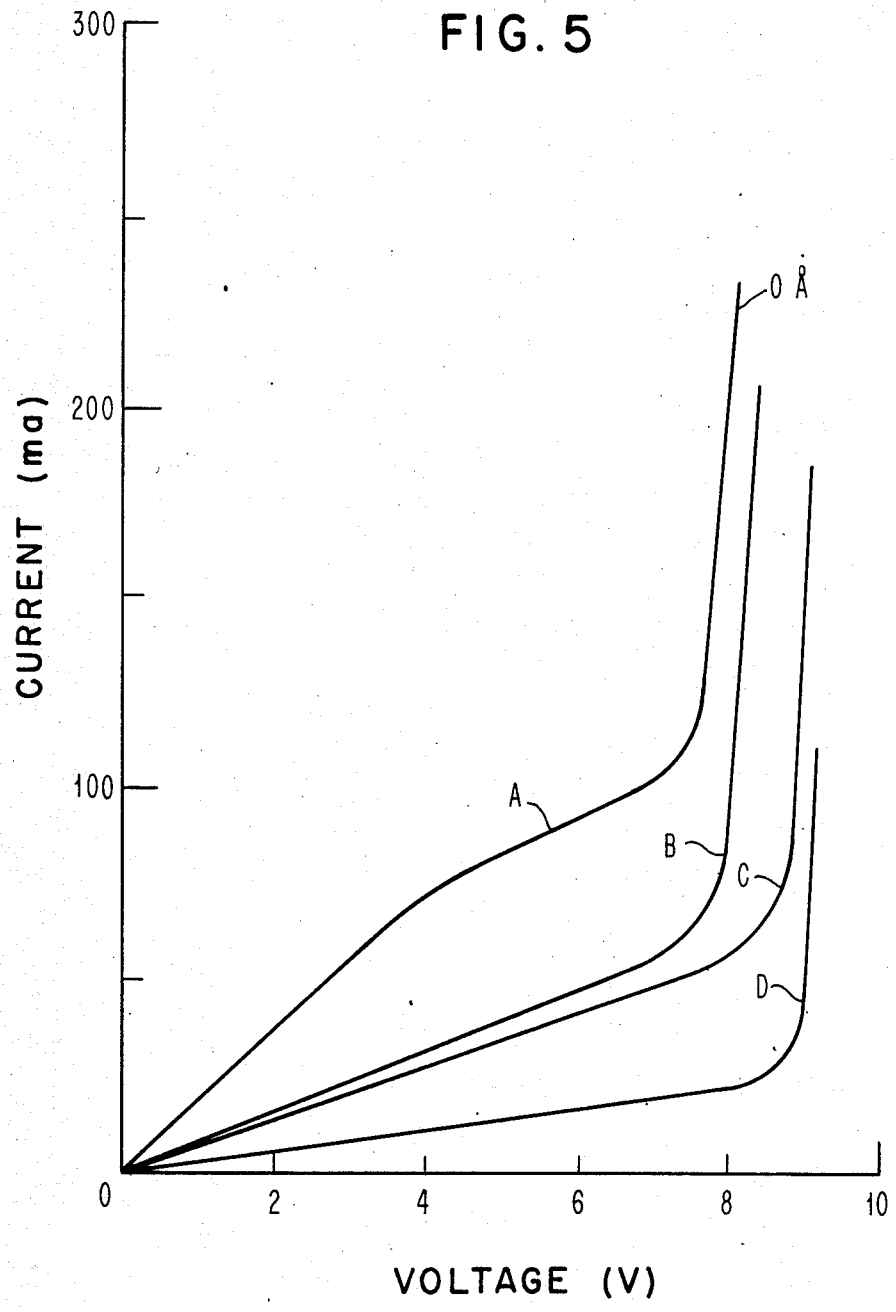
FIG. 5 is a plot of the current-voltage characteristics of the resistive ribbon of the present invention, where the electrical interface layer is comprised of a symmetrical alkylalkoxy silane, being in this example tetrabutoxy silane.

FIG. 5 is an I-V plot for some sample ribbons, which were comprised of a graphite-filled polycarbonate layer as the resistive layer and a 1000 angstrom Al layer. Located between the resistive layer and the Al layer was a plasma polymerized alkylalkoxy silane. For this set of data, a symmetric alkylalkoxy silane, tetrabutoxy silane, was used. Curve A illustrates the ribbon characteristic when no interface layer is present, while curves B–D indicate the presence of increasing thicknesses of electrical interface layer. For example, the ribbon used to provide curve D had a thicker interface layer than the ribbon of curve C, which in turn had a thicker interface layer than the ribbon used to obtain curve B.

The interface resistance was enhanced using this symmetrical alkylalkoxy silane, but the knee voltage was not significantly enhanced. Although some improvement in knee voltage is obtained, the amount of increase in $V_K$ is not as great as when nonsymmetrical alkylalkoxy silanes are used.

Figure 6:
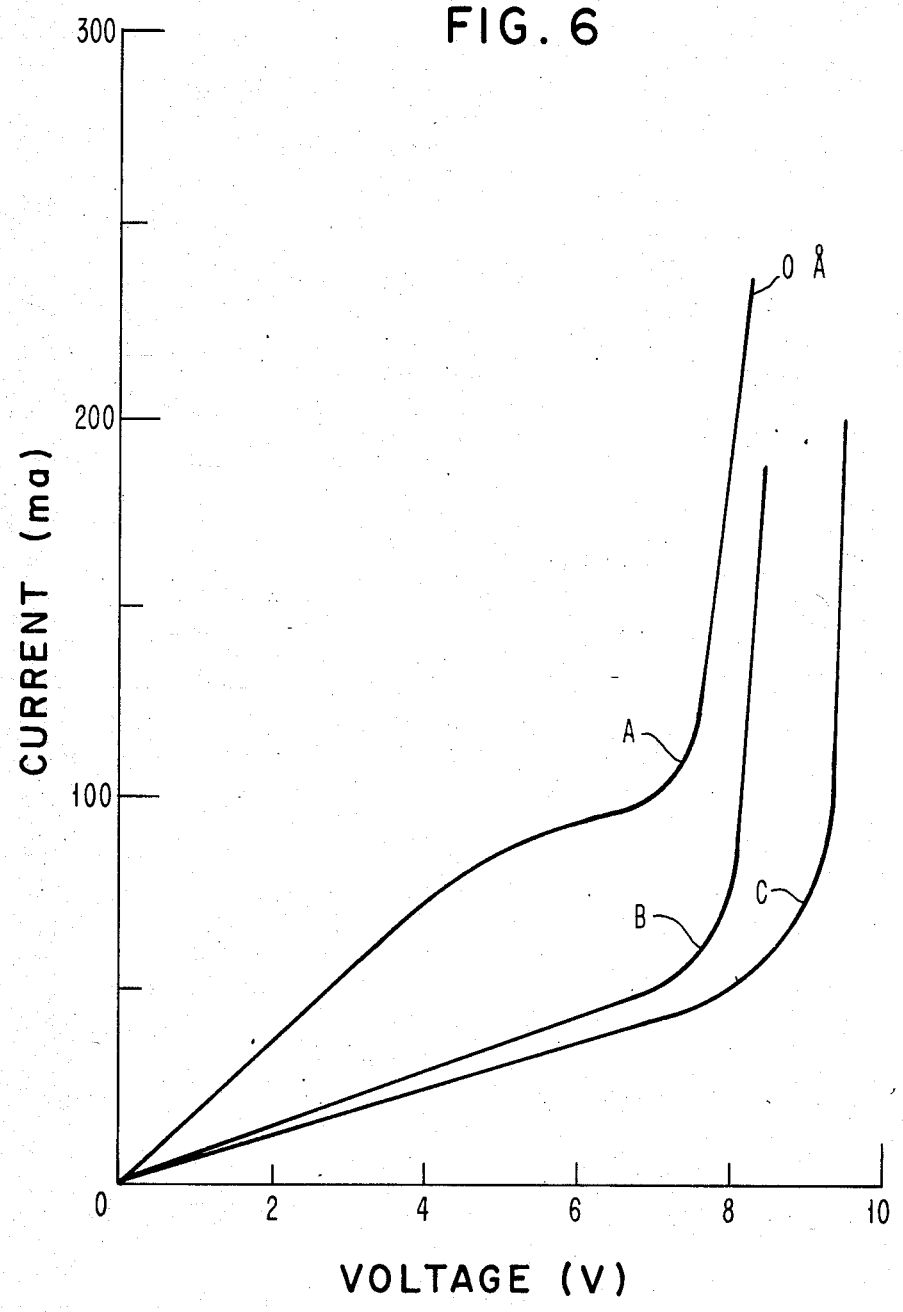
FIG. 6 is a plot of the current-voltage characteristics for the resistive ribbon of FIG. 1, where the electrical interface layer is comprised of different thicknesses of the alkylalkoxy silane, which in this example is plasma polymerized butyltrimethoxy silane.

FIG. 6 shows the I-V characteristics of 3 ribbons, as represented by curves A, B, and C. Curve A is for a ribbon which did not include an electrical layer, but which included layers of resistive material and a metal current-return conductor. In this case, the resistive layer was graphite-filled polycarbonate, while the metal layer was 1000 angstroms of Al.

Curves B and C show the I-V characteristics of the same ribbon, but in which an electrical interface layer comprised of plasma polymerized butyltrimethoxy silane was used between the resistive layer and the Al layer. The thickness of the interface layer is greater in the ribbon used to derive curve C than that in the ribbon used to derive curve B.

Butyltrimethoxy silane is a non-symmetric alkylalkoxy silane, and therefore both the interface resistance and the knee voltage of the ribbon are increased by incorporation of this electrical interface layer. The increases in interface resistance and the knee voltage are greater as the thickness of the electric layer is increased.

Figure 7:
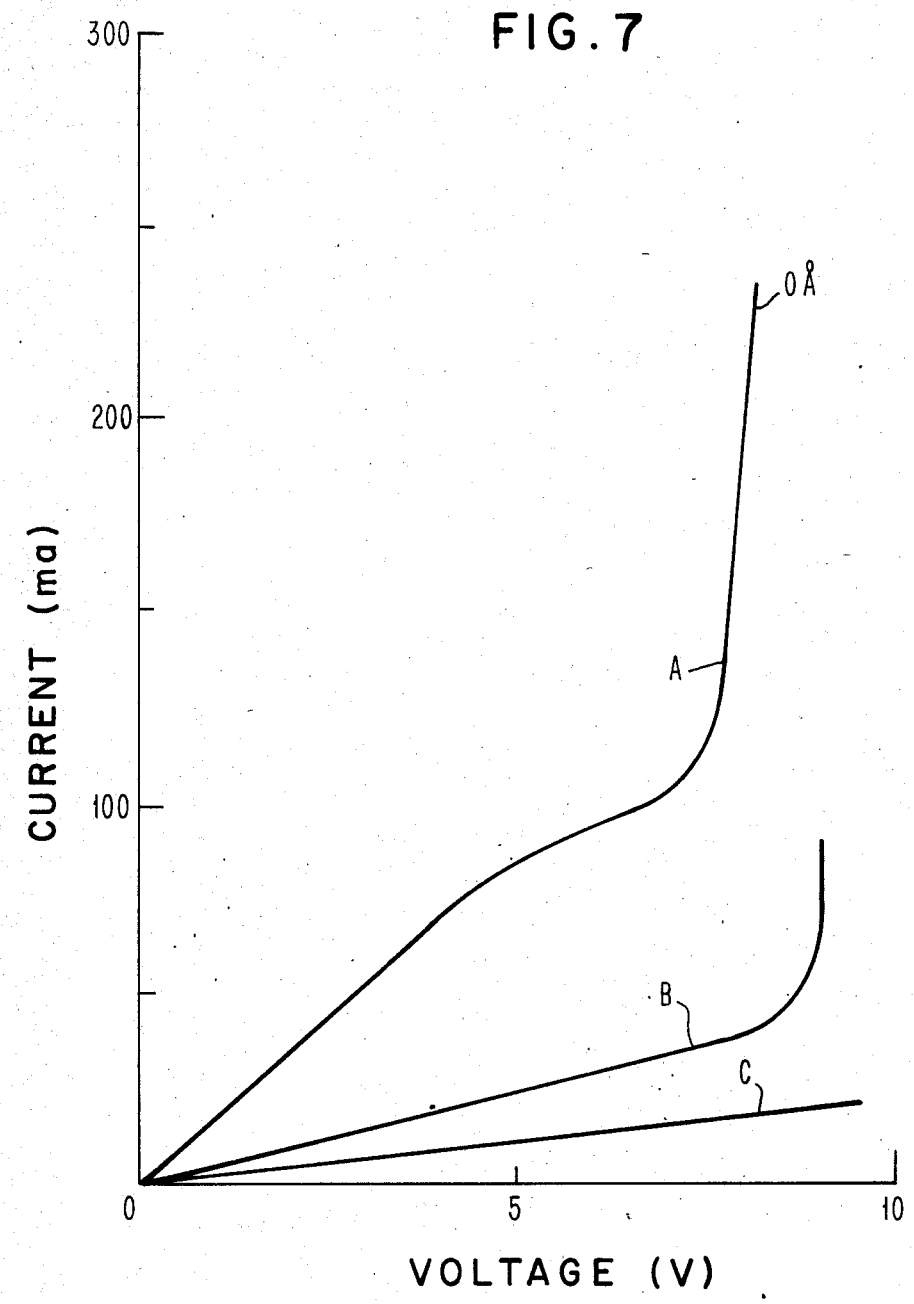
FIG. 7 is a plot of current-voltage characteristics for another resistive ribbon in accordance with the present invention, where the characteristics were developed for different thicknesses of an electrical interface layer comprised of butyltrimethoxy silane which was produced by plasma polymerizing a vapor of the silane introduced into a plasma chamber.

FIG. 7 shows three I-V curves for resistive ribbons in which the presence of the electrical interface layer shifts the I-V characteristic. Curve A is that for a ribbon which does not contain an electrical interface layer, the ribbon being comprised of a graphite-filled polycarbonate resistive layer and a thin layer of Al. Curves B and C are for the same ribbon, except that an electric interface layer is included between the resistive layer and the Al layer. The interface layer is the same as that used to obtain the curves of FIG. 6, butyltrimethoxy silane, but in this case this silane was produced by introducing a vapor rather than a liquid into a plasma chamber. Further, the thicknesses of the electric interface layers used in the ribbons of FIG. 7 are greater than the thicknesses of the interface layers used in the ribbons of FIG. 6. This is the primary reason why the ribbons of FIG. 7 exhibit greater interface resistances and knee voltages than the ribbons of FIG. 6.

Figure 8:
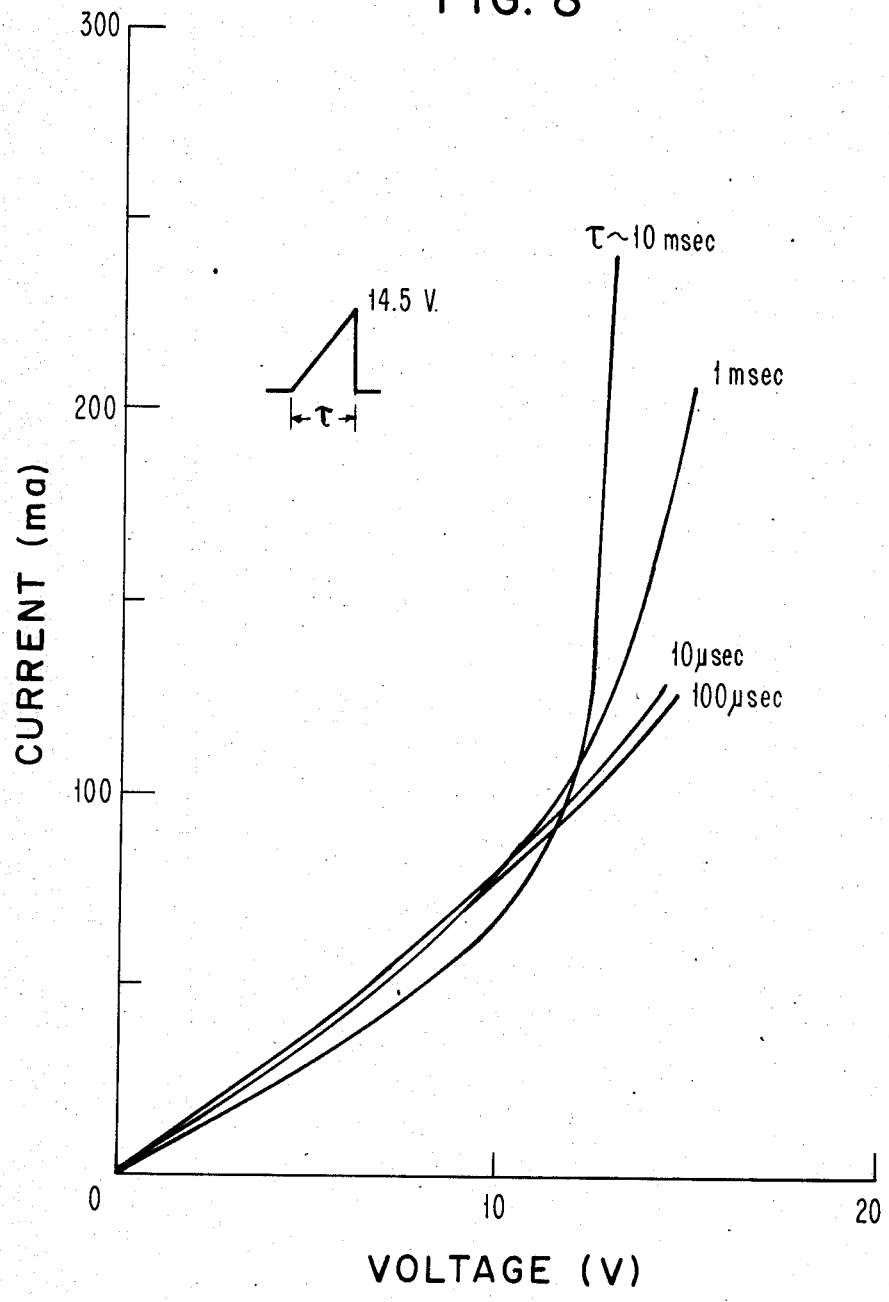
FIG. 8 is a plot of current versus voltage for the improved resistive ribbon of FIG. 1, including an electrical interface layer comprised of octadecyltriethoxy silane, where the I-V curves result from application of electrical pulses having different rise times.

FIG. 8 is an I-V plot for a resistive ribbon including an electrical interface layer comprised of octadecyltriethoxy silane located between a graphite-filled polycarbonate resistive layer and an Al metal layer, where the curves are generated for different rise times $\tau$ of an applied ramp pulse having a peak voltage of 14.5 V. The thicknesses of the electrical interface layers were 500–1000 angstroms.

From these curves, it is apparent that the amount of energy delivered to the ribbon has an effect on the electrical properties of the ribbon, there being a type of non-linear breakdown when the pulse width (rise time) becomes sufficiently great that a large quantity of energy is supplied to the electrical layer.

Figure 9:
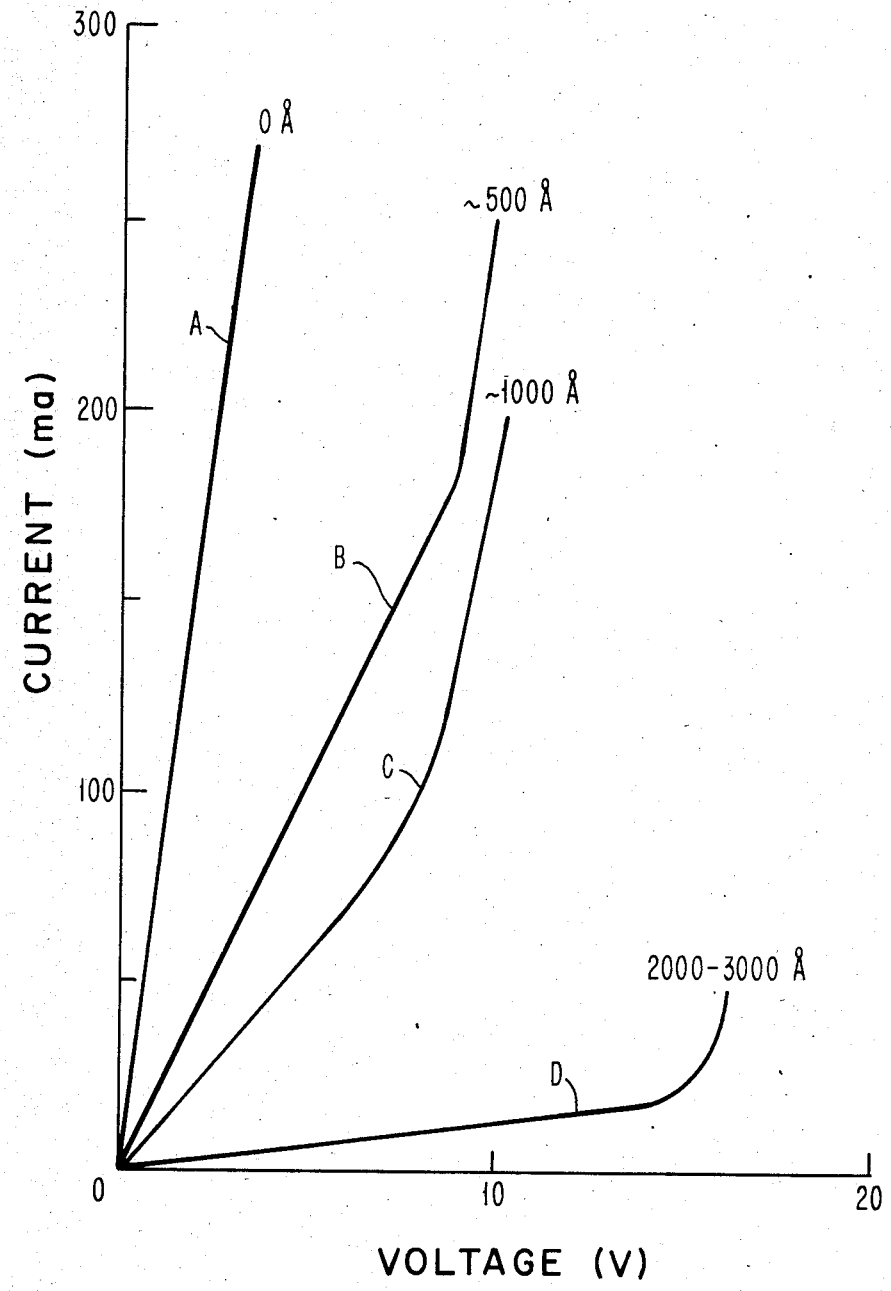
FIG. 9 is a plot of current versus voltage for the ribbon of FIG. 1, in which the electrical interface layer is plasma polymerized octadecyltriethoxy silane and the thin conductive layer is Au.

FIG. 9 shows the I-V characteristics of a ribbon without an electrical interface layer (curve A) and 3 ribbons of identical structures, except that they include an electrical interface layer (curves B, C, D). All of these ribbons were comprised of a resistive layer of graphite filled polycarbonate, and a thin metal current return layer of 1000 angstroms thickness. The interface layers were plasma polymerized octadecyltriethoxy silane of thicknesses of about 500 angstroms (curve B), 1000 angstroms (curve C), and 2000–3000 angstroms (curve D). For these ribbons, the metal current return layer was Au, in contrast to the Al metal layer of, for example, the ribbons of FIG. 2.

The presence of the Au layer in contrast to an Al layer changes the I-V characteristics somewhat, as can be seen by comparing FIGS. 2 and 9, in which the ribbons used differed only in the metal forming the current return layer. When the current return layer is Au, the interface resistance and knee voltage are less than when the current return layer is Al, which is most likely due to the fact that when Al is used, a thin $Al_2O_3$ layer forms that increases interface resistance and knee voltage. An oxide layer will not be formed on a Au layer. For all metals, however, there is a significant increase in interface resistance and knee voltage when the ribbon includes an electrical interface layer in accordance with this invention.

As noted previously, it is possible to alter the electrical characteristics of the electrical interface layer by changing its resistivity, etc., as for instance, by doping the interface layer. For example, an interface layer comprising polyimide can be doped with carbon to change the electrical resistivity of that layer. The doping will also affect the interface resistance and the knee voltage of the ribbon.

In the practice of this invention, a thin electrical interface layer is placed between the resistive layer and the metal current-return layer in a resistive printing ribbon, for the purpose of altering the electrical characteristics of the ribbon. The interface layer can be used in any type of resistive ribbon, such as those with organic resistive layers and those with inorganic resistive layers. The interface layer is chosen to make the knee voltage of the I-V characteristic of the ribbon greater than about 6 volts, and to increase the interface resistance. The interface layer must be a continuous, pinhole-free layer whose presence does not alter the flexibility, stability, and durability of the ribbon. In order to achieve these characteristics, the electric interface layer must be very thin and for this reason is less than approximately 1000 angstroms in thickness. At this thickness, it must provide the required electrical properties and, therefore, polymer films are preferred. Such films can be applied in a variety of conventional processes to provide uniform thickness and substantially uniform composition in order to have the electrical properties of this layer be substantially uniform throughout the length of the ribbon. In this regard, it is known that metal oxides, such as $Al_2O_3$, cannot be made pinhole-free at such small thicknesses, and do not exhibit the required electrical properties, especially in a uniform manner throughout the length of the ribbon.

While the invention has been described with respect to particular embodiments thereof, it will be apparent to those of skill in the art that variations can be made therein without departing from the spirit and scope of the invention. Thus, it is envisioned that other polymer films can be provided which will produce the required electrical results, while at the same time not adversely affecting the mechanical and chemical properties of the ribbon. Further, if a conductive current return layer is not used, the electrical layer is located between the resistive layer and the ink layer.

Having thus described our invention, what we claim as new and desire to secure by Letters Patent is:

1. An improved resistive ribbon for electrothermal printing, comprising:

a resistive layer through which electric current passes from an electrode to produce localized heating to effect printing, an ink layer comprised of an ink which is transferrable when heated by said localized heating, a metal layer along which said electrical current passes, and an electrical interface layer located between said resistive layer and said metal layer, wherein said current passes through said electrical interface layer to produce hearing due to the resistance of said electrical interface layer, said electrical interface layer increasing the interface resistance of said ribbon and introducing a non-linear current-voltage characteristic with a knee voltage in excess of 6 volts.

2. The ribbon of claim 1, where said electrical interface layer is less than about 1000 angstroms thick.

3. The ribbon of claim 1, where said electrical interface layer is a continuous, substantially pinhole-free layer.

4. The ribbon of claim 1, where said electrical interface layer is a polymer.

5. The ribbon of claim 1, where said resistive layer is a polymer layer and said metal layer is chosen from the group consisting of Al, Ni, Cu, stainless steel, and Au.

6. The ribbon of claim 5, where said polymer resistive layer is comprised of polycarbonate.

7. An improved resistive ribbon for electrothermal printing, comprising:

a resistive layer through which electric current passes from an electrode to produce localized heating to effect printing, an ink layer comprises of an ink which is transferrable when heated by said localized heating, a metal layer along which said electrical current passes, and an electrical interface layer located between said resistive layer and said metal layer, wherein said current passes through said electrical interface layer to produce heating due to the resistance of said electrical interface layer, said electrical interface layer increasing the interface resistance of said ribbon and introducing a non-linear current-voltage characteristic with a knee voltage in excess of 6 volts, said electrical interface layer being a polymer selected from the group consisting of alkylalkoxy silanes having the formula $$(RO)_m—Si—(R')_{4-m}$$

where m=1, 3 (non-symmetrical materials)

m=2, 4 (symmetrical materials)

$R=—CH_3, (CH_2)_p—CH_3$ p=0, 1, 2, 3

$R'=(CH_2)_n—CH_3$ n=0, 1, 2, . . . , 21 and branched isomers thereof.

8. The ribbon of claim 7, where m=2, 4.

9. The ribbon of claim 7, where m=1, 3.

10. An improved resistive ribbon for electrothermal printing, comprising:

a resistive layer comprising a polymer having conductive particles therein, a metal layer, an ink layer comprised of an ink which is transferrable when heated, and an electrical interface layer less than about 1000 angstroms in thickness located between said resistive layer and said metal layer, said electrical interface layer providing said ribbon with a nonlinear current-voltage curve when electrical current is passed from an electrode through said electrical interface layer during electrothermal printing, the knee voltage of said current-voltage curve being in excess of 6 volts and wherein said electrical interface layer introduces an interface electrical resistance to the flow of electrical current therethrough during said electrothermal printing.

11. The ribbon of claim 10, where said electrical interface layer is an alkylalkoxy silane having the general formula $$(RO)_m—Si—(R')_{4-m}$$

where m=1, 3 (non-symmetrical materials)

$R=—CH_3, (CH_2)_p—CH_3$ p=0, 1, 2, 3

$R'=(CH_2)_n—CH_3$ n=0, 1, 2, . . . , 21 and branched isomers thereof.

12. The ribbon of claim 10, where said electrical layer is an alkylalkoxy silane having the general formula $$(RO)_m—Si—(R')_{4-m}$$

where m=2, 4 (symmetrical materials)

$R=—CH_3, (CH_2)_p—CH_3$ p=0, 1, 2, 3

$R'=(CH_2)_n—CH_3$ n=0, 1, 2, . . . , 21 and branched isomers thereof.

13. The ribbon of claim 10, where said electrical interface layer is a substantially pinhole-free continuous polymer layer.

14. The ribbon of claim 13, where said metal layer is Al.

15. The ribbon of claim 14, where said polymer layer is an alkylalkoxy silane having the general formula $$(RO)_m—Si—(R')_{4-m}$$

where m=1, 2, 3, 4

$R=—CH_3, (CH_2)_p—CH_3$ p=0, 1, 2, 3

$R'=(CH_2)_n—CH_3$ n=0, 1, 2, . . . , 21 and branched isomers thereof.

16. An improved resistive ribbon for electrothermal printing, comprising:

a resistive layer through which electrical current flows from an electrode during a printing operation, an ink layer comprised of an ink which is transferrable when heated by localized heating due to said current flow, a metal layer along which said electrical current passes, and an electrical interface layer of thickness less than about 1000 angstroms located between said resistive layer and said metal layer, and being comprised of a non-symmetrical alkylalkoxy silane.

17. The ribbon of claim 16, where said alkylalkoxy silane has the general formula $$(RO)_m—Si—(R')_{4-m}$$

where m=1, 3 (non-symmetrical materials)

$R=—CH_3, (CH_2)_p—CH_3$ p=0, 1, 2, 3

$R'=(CH_2)_n—CH_3$ n=0, 1, 2, . . . , 21 and branched isomers thereof.

18. The ribbon of claim 17, where said metal layer is aluminum.

* * * * *